US006503112B1

(12) United States Patent
Chadwick et al.

(10) Patent No.: US 6,503,112 B1
(45) Date of Patent: Jan. 7, 2003

(54) CATENARY ANCHOR LEG MOORING BUOY

(75) Inventors: Samuel Andrew Chadwick, Aberdeen (GB); Duncan Cuthill, Aberdeen (GB); Marin Leon Kobiela, Aberdeenshire (GB)

(73) Assignee: Trident Offshore Limited (GB)

( * ) Notice: Subject to any disclaimer, the term of this patent is extended or adjusted under 35 U.S.C. 154(b) by 0 days.

(21) Appl. No.: 09/979,835

(22) PCT Filed: May 26, 2000

(86) PCT No.: PCT/GB00/02021

§ 371 (c)(1),
(2), (4) Date: Mar. 8, 2002

(87) PCT Pub. No.: WO00/73133

PCT Pub. Date: Dec. 7, 2000

(30) Foreign Application Priority Data

May 27, 1999 (GB) ..... 9912366

(51) Int. Cl.[7] ..... B63B 22/02
(52) U.S. Cl. ..... 441/3
(58) Field of Search ..... 441/3–5, 6

(56) References Cited

U.S. PATENT DOCUMENTS

| | | | | |
|---|---|---|---|---|
| 3,541,622 A | * | 11/1970 | Harlow | 441/3 |
| 3,786,525 A | | 1/1974 | Christians et al. | |
| 4,449,946 A | | 5/1984 | Versluis et al. | |
| 5,651,709 A | | 7/1997 | Nandakumar et al. | |

FOREIGN PATENT DOCUMENTS

| | | |
|---|---|---|
| FR | 2029884 | 10/1970 |

* cited by examiner

*Primary Examiner*—Ed Swinehart
(74) *Attorney, Agent, or Firm*—Samuels, Gauthier & Stevens

(57) ABSTRACT

A catenary anchor leg mooring (CALM) buoy of modular construction comprises an open framework and at least one replaceable buoyancy module. The buoyancy module is mounted to the framework. The CALM buoy also comprises mooring means and fluid application means which are rotatably mounted to the framework via a two-armed turntable. The framework may comprise elongate frame members. Preferably a plurality of buoyancy modules are provided, each detachably mounted in a symmetric configuration within the framework.

11 Claims, 2 Drawing Sheets

CATENARY ANCHOR LEG MOORING BUOY

TECHNICAL FIELD

This invention relates to a catenary anchor leg mooring buoy of lightweight construction.

BACKGROUND

Conventional Catenary Anchor Leg Mooring (CALM) Buoys are used extensively to facilitate offshore marine terminals for the import or export of crude oil (and other fluids).

The CALM buoy is generally moored to a 4, 6 or 8 point mooring system (dependent upon operational requirements, environmental conditions, water depth etc). The tanker to be loaded (or offloaded) moors directly to the buoy and connects to a floating hose which carries the fluid product.

The fluid hose and the mooring assembly arrangements on the CALM buoy are swivel mounted in order that the tanker can "weathervane" around the buoy thus maintaining a heading into the wind/weather at all times.

The use of a CALM buoy provides a low cost marine terminal as dedicated port or harbour facilities are not required for tanker mooring. The CALM buoy design allows the tanker to moor directly to the buoy and the fluid transfer pipeline may run from the shore facility to the CALM buoy.

Conventional CALM buoys have been in use in the offshore industry for many years and have proved to be a cost efficient method for the transfer of petroleum products from a seabed production facility to an offtake tanker (or vice versa).

Conventional CALM buoys generally take the form of a large steel cylinder with a central opening or so-called "moonpool" and a rotating turntable or arm section fitted to the top of the buoy. Generally the turntable is made up of three "arms", the mooring arm, the offtake arm and a counterbalance arm.

The tanker is moored to the mooring arm of the turntable via a hawser mooring system. The tanker is free to weathervane around the buoy by the mooring loads applying rotational forces to the turntable. The turntable is fitted to the main body of the buoy via a large slew bearing arrangement.

A riser/hose system is connected from the seabed facility to a fluid swivel located in the centre of the moonpool. The output flange of the fluid swivel is connected to a pipe that is fixed on to the turntable's offtake arm and leads off the buoy to an offtake hose connected to the tanker.

The main body of the buoy is generally moored to the seabed via four, six or eight mooring lines. The method used to tension and attach the mooring lines to the buoy differs between designs, but generally the lines are tensioned with an on board winch and gantry arrangement also used for attaching the mooring hawser and offtake hoses. The mooring lines are then locked in to place by a locking device such as a chain stopper. The components of the mooring system are dependent on the water depth, the environment associated with the location where the buoy is to be moored, and the size of the offtake tanker.

Conventional CALM buoys are generally constructed of a steel plate hull divided into several tanks, with a central moonpool and a steel turntable. Due to the steel plate construction the buoys generally weigh in excess of 150 tonnes and can have an overall diameter of up to 15 m.

These conventional CALM buoys are utilised within the offshore oil industry as a cost effective solution for long term offshore projects. However, for short term projects such as well tests and extended well tests they have certain disadvantages.

There are three main areas which render current CALM buoy designs unsuitable for short term projects, these are capital cost, transportation and installation costs and maintenance and repair costs.

The initial purchase cost of a conventional CALM buoy design is high due to the complex construction techniques involved, the quantity of steel required, the requirement for a dockyard/steelworking facilities and the time required.

Due to the size and weight of conventional CALM buoys and their mooring systems the transportation and installation can be time consuming and expensive especially if the final location is distant.

The maintenance and repair of conventional CALM buoys can be expensive due to their size. There is a great deal of steelwork to be surveyed, thickness measurements taken and paint work to be checked. Should one of the hull compartments be breached then the buoy has to be removed and dry-docked. Should the slew bearing suffer damage the buoy generally requires to be removed to a shore facility for repair. Production time for the marine terminal will be lost while a replacement arrangement is installed.

For a long term project such as oil production/export systems the costs associated with conventional CALM buoys are generally acceptable and cost effective when compared to the use of a fixed installation or the provision of port facilities.

For a short term project such as a well test or an extended well test in a remote area costs can be prohibitive.

SUMMARY OF THE INVENTION

It is an object of the present invention to provide a lightweight CALM buoy design which can be easily and quickly constructed and which can be maintained and repaired in a cost effective manner. The lightweight CALM buoy design is intended to be a cost effective solution for short term projects which require a tanker mooring facility and the transfer of fluids offshore.

U.S. Pat. No. 4,449,946 describes a mooring buoy of modular construction composed of an open framework mounting buoyancy modules which act as fenders.

According to the present invention and as is known from U.S Pat. No. 4,449,946 and as is known from U.S. Pat. No. 1,449,946 there is provided a catenary anchor leg mooring (CALM) buoy of modular construction and comprising a main framework, at least one replaceable buoyancy module mounted to the main famework, mooring means and fluid application means rotatably mounted to said main framework and serving for connection to an offshore structure, such as a tanker, and means for attachment to at least one mooring line for mooring the buoy.

In contrast to U.S. Pat. No. 4,449,946 and in accordance with the invention the buoyancy module is held wholly within the framework so as to be protected against collision damage and the attachment means for the at least one mooring line is provided on the framework. Accordingly the framework is anchored by the mooring line.

Several detachably mounted modules can be symmetrically mounted to the main framework. Preferably the main framework comprises several elongate frame members which may be structural sections such as tubulars and can be steel.

Preferably the or each buoyancy module is a conventional elastomer material buoy.

More preferably six or twelve of said buoyancy modules are provided, one or two respectively being positioned in each of six segments of the main framework of hexagonal configuration in plan view.

Internal framework may be used within the main framework to mount the buoyancy modules.

Preferably also the mooring means and fluid offtake means are provided on a single arm assembly rotatably mounted on the main framework. The arm assembly then has two arm sections—a mooring arm section and a counterbalance arm section.

The mooring lines for mooring the buoy may be three lines secured at 120° intervals or, if extra security is required, six lines.

Embodiments of the present invention will now be described, by way of example only, with reference to the accompanying drawings in which:

DETAILED DESCRIPTION OF PREFERRED EMBODIMENTS

Figure 1:
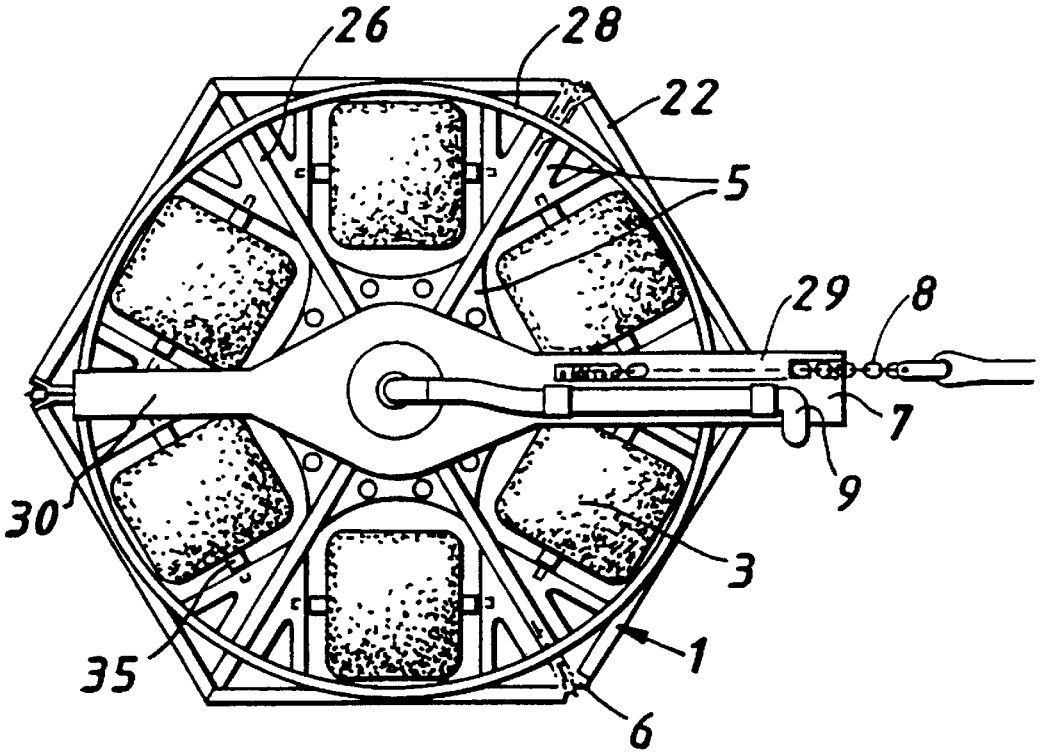
FIG. 1 is a plan view of a catenary anchor leg mooring buoy in accordance with the present invention.
Figure 2:
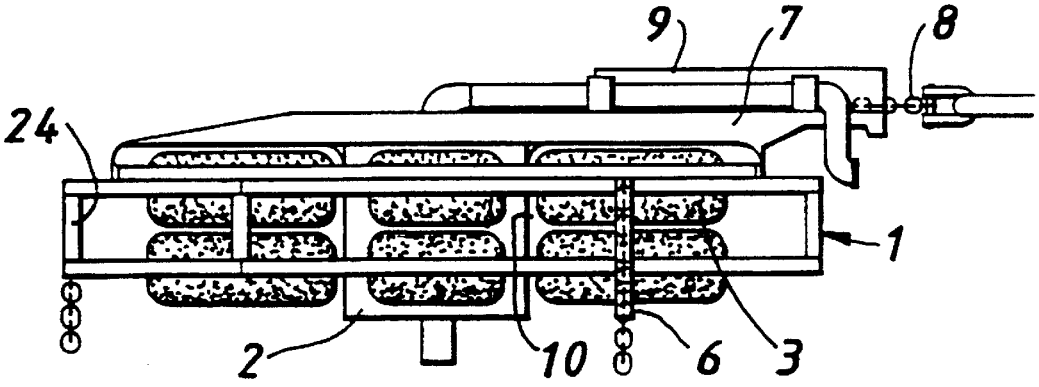
FIG. 2 is a side view of the buoy of FIG. 1.

Referring to FIGS. 1 and 2, a catenary anchor leg mooring buoy constructed in accordance with the present invention is a modular design based upon a rigid steel load bearing main framework 1. The main framework 1 comprises several elongate frame members 22, 24, 26. Upper and lower tangential frame members 22 form an upper and lower hexagonal configuration. Six axial frame members 24 join the comers of the upper and lower hexagons and six radial frame members or spokes 26 join the hexagon corners to a centre. The frame members are constructed from standard sized tubular or other structural section material additionally fitted with stiffeners 5 to strengthen the structure. The framework may take shapes other than hexagonal for example, circular or octagonal.

Contained within the framework 1 are twelve prefabricated 12 tonne buoyancy modules 3. These modules 3 are constructed with an internal framework 35 positioned through the centres, therefore allowing them to be secured to the main framework 1. The buoyancy modules 3 are secured to the main framework 1 in such a manner that they can easily be replaced should they be damaged. In the embodiment shown in FIGS. 1 and 2 the buoyancy modules 3 are supported by the internal framework 35 attached to the stiffeners 5 although alternative supports may be provided.

A fixed central body 10 sits at the centre of the hexagonal framework 1 with a moonpool 2 running axially through it. An arm section 7 is swivel mounted on the upper part of the central body via a rotatable coupling incorporating a bearing. The arm section 7 comprises a mooring 29 arm and a counter balance arm 30 as described below.

In the embodiment illustrated the lower fixed section 10 is moored by three mooring lines 6 secured to the buoy at 120° intervals. As utilised in conventional CALM buoy designs the mooring line is attached to the buoy using an existing termination device such as a chain stopper.

The mooring system required to moor the buoy is dependent upon the water depth and environmental conditions associated with a particular location. Dependent upon the nature of intended service, water depth, mooring loads etc the basic design may be adapted such that it may be moored to six mooring lines. However, for well test and extended well test applications where the buoy may be regarded as a temporary installation, it is envisaged that three mooring lines will be sufficient.

The upper rotating arm section 7 of the buoy is the part to which an offtake tanker is attached on the mooring arm via chain 8 with the tanker therefore free to weathervane around the fixed buoy. A product offtake hose 9 is also fitted on the rotation arm section 7 allowing the fluid product to be transferred to the tanker via a flexible hose. In the embodiment illustrated in FIGS. 1 and 2 the mooring arm 29 serves to hold the offtake hose. Opposite to the offtake and mooring arm 29 is the counter balance arm 30, which is required to keep the buoy level when the tanker is disconnected.

Unlike conventional CALM buoy designs the same arm section and in this embodiment the same arm 29 is utilised for both tanker mooring and offtake hose although the tanker mooring line is fixed clear of the offtake hose. A single counterbalance arm is used and the use of only two arms reduces the weight of the turntable when compared to conventional CALM buoys. The rotating arm section 7 comprising these two arms runs on a circular track 28.

Figure 3:
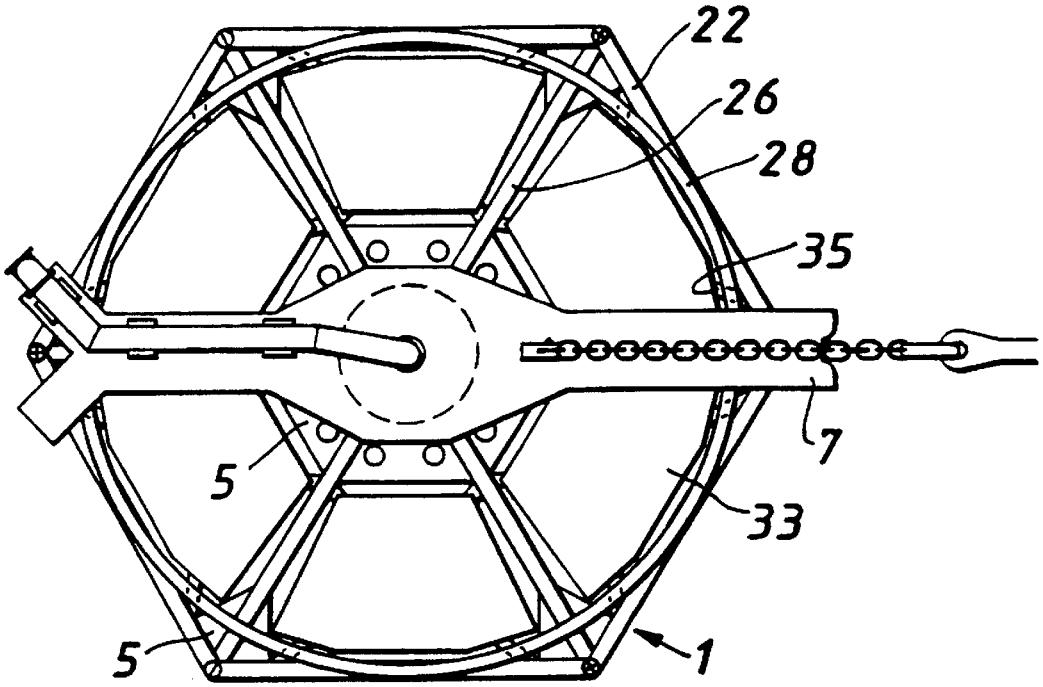
FIG. 3 is a plan view of an alternative embodiment of the catenary anchor leg mooring buoy.
Figure 4:
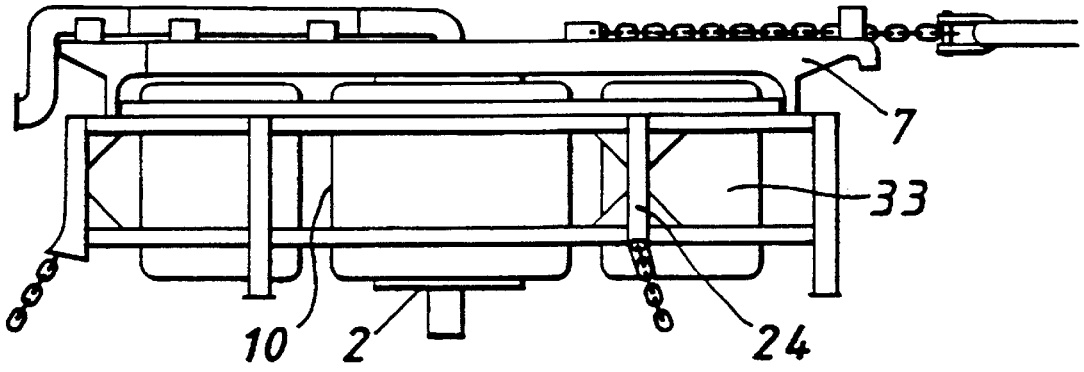
FIG. 4 is a side view of the buoy of FIG. 3.

The alternative embodiment shown in FIGS. 3 and 4 has a similar general structure to the embodiment of FIGS. 1 and 2. Again, the embodiment has a modular design which incorporating a main rigid steel load bearing framework 1. Elongate frame members 22, 24, 26 are again included as is the fixed central body 10 with central moonpool 2. These are consistent with those described with reference to FIGS. 1 and 2. Stiffeners 5 are also included to again strengthen the structure. However, in this embodiment only six prefabricated buoyancy modules 33 are contained within the main framework 1 and these are likewise attached to the framework 1 via an internal load bearing framework 35. Also in this embodiment, the counter-balance arm bears the offtake hose which is thus kept clear of the tanker mooring line fixed to the mooring arm. Again, like the embodiment in FIGS. 1 and 2, only two arms are used effecting the same reduced weight. The rotating arm section 7 again runs on a circular track 28.

In the embodiments described and illustrated it can be seen that the buoyancy modules 3 are held wholly within the main framework 1. The buoyancy modules 3 are therefore protected from possible damage caused by vessel collision with the buoy. Furthermore, a level of redundancy in overall reserve buoyancy is provided so that the CALM buoy would remain afloat if a single buoyancy module was to fail for any reason.

A low cost fluid swivel arrangement, reflecting the limited operational duration of well test activities, is utilised to reduce costs and overall weight.

There are several areas where the buoy design of the present invention has advantages over conventional design for short term projects. These advantages include:—Lower Construction Costs: The initial costs of the lightweight CALM design are significantly less than those associated with conventional steel CALM buoy designs, this is mainly due to the modular construction of the buoy.

Instead of constructing a compartmentalised hull the lightweight CALM buoy requires only the connection of prefabricated steel tubulars or sections into a framework and the fitting of buoyancy sections. Therefore, cost savings are made due to the reduced construction time, reduced shipyard costs and a reduction in steel required.

To reduce capital costs further the buoyancy modules may be available through the rental market. They may be hired for the duration of a project and returned to the equipment rental company when the CALM buoy is not in use.

The lightweight CALM buoy is designed to be fitted with three mooring lines (although six may be used for some applications). This reduces the mooring components required and reduces the installation time at the operating location.

The turntable arrangement for the lightweight CALM buoy is of a much simpler design than is found on conventional steel CALM buoys. This reduces the construction time and costs.

Reduced Transportation/Installation Costs:

The use of a frame structure, buoyancy modules and a two arm turntable greatly reduces the weight of the buoy when compared to conventional designs. This reduction in weight provides significant advantages and provides greater options for the transportation, handling and installation of the buoy and therefore reduces costs.

The modular construction would allow the buoy to be shipped in prefabricated sections for assembly at a site in proximity to the offshore operation location.

Reduced Maintenance/Repair Costs:

Following completion of a project and demobilisation of the lightweight CALM buoy, overhaul of the buoy will be readily achieved due to the simplified construction and the modular components.

During operations the maintenance required to be carried out on the buoy should be minimal due to the simple and robust construction of both the framework and the turntable.

Should any part of the steel framework become damaged the replacement of any particular member would be straightforward and of short duration. This is unlike the major repair work that would be required to replace damaged shell plating on a current CALM buoy.

Also, if the framework were breached and filled with water the buoyancy modules would easily overcome the added weight due to the minimal amount of water that can be contained within the frame.

The buoy has been designed to allow the buoyancy modules to be replaced easily should they become damaged or worn. The steel bar positioned through each of the modules in the first embodiment need not be welded to the supporting framework but can be secured so that simple connection and disconnection is effected, for example bolts, straps or other fastening devices can be used in either embodiment.

Further advantages can be seen. The design allows simplified modification to accept larger or smaller buoyancy units which may be standard or non-standard sizes. The basic design can, therefore, be adapted for many design load scenarios (buoy moorings and tanker mooring loads).

The preferred buoyancy units are standard size elastomer buoys. They are commonly used in the offshore industry, are available at short notice and can be fitted and removed rapidly. This reduces repair time in the event of damage to a buoyancy unit. The upper buoyancy units may be removed and replaced with the CALM buoy remaining on location.

The preferred turntable arrangement is of a simplified design which has a load arm and a counterbalance arm. The preferred slew bearing is of small radius.

The preferred lightweight CALM buoy mooring arrangement is intended to be three mooring lines set at 120° intervals to provide the position keeping envelope required. For added security (which may be required for longer term projects or those located in a harsher environment) a maximum of six mooring lines set at 60° intervals may be fitted.

What is claimed is:

1. A catenary anchor leg mooring (CALM) buoy of modular construction and comprising an open framework, at least one replaceable buoyancy module mounted internally of the framework, mooring means and fluid application means rotatably mounted to said framework and serving for connection to an off shore structure, and means for attaching at least one mooring line for mooring the buoy; characterized in that said at least one module is held wholly within the framework so as to be protected against collision damage and the means for attaching said at least one mooring line is provided on the framework.

2. A CALM buoy according to claim 1, wherein the at least one buoyancy module is detachably mounted to the framework.

3. A CALM buoy according to claim 1, wherein the framework comprises elongate frame members.

4. A CALM buoy according to claim 1, wherein the mooring means and fluid application means are rotatably mounted to said framework via a two-armed turntable.

5. A CALM buoy according to claim 4, wherein the two-armed turntable comprises a mooring arm and a counter-balance arm.

6. A CALM buoy according to claim 1, wherein the at least one buoyancy module takes the form of a plurality of buoyancy modules.

7. A CALM buoy according to claim 6, wherein the buoyancy modules are symmetrically mounted to the framework.

8. A CALM buoy according to claim 1, wherein the or each buoyancy module is attached to the framework by way an internal framework.

9. A CALM buoy according to claim 1, wherein the framework has a hexagonal configuration in plan view.

10. A CALM buoy according to claim 1, wherein the framework is constructed from structural sections such as tubulars.

11. A CALM buoy according to claim 10, wherein the structural section material is steel.

* * * * *